US008651003B1

(12) United States Patent
Vercellone

(10) Patent No.: US 8,651,003 B1
(45) Date of Patent: Feb. 18, 2014

(54) POWER-OPERATED TOILET PAPER DISPENSING DEVICE AND ASSOCIATED METHOD

(76) Inventor: Bernard M. Vercellone, Angelus Oaks, CA (US)

( * ) Notice: Subject to any disclaimer, the term of this patent is extended or adjusted under 35 U.S.C. 154(b) by 765 days.

(21) Appl. No.: 12/378,358

(22) Filed: Feb. 13, 2009

Related U.S. Application Data

(60) Provisional application No. 61/065,832, filed on Feb. 19, 2008.

(51) Int. Cl.
*B26D 7/00* (2006.01)
*B65H 16/06* (2006.01)
*B65H 18/04* (2006.01)

(52) U.S. Cl.
USPC ..... 83/649; 83/648; 83/650; 242/598.6

(58) Field of Classification Search
USPC ..... 83/648–650; 225/10–12, 14–15, 23, 34, 225/37–38, 77; 242/540, 546, 598.5, 598.6, 242/563, 564
See application file for complete search history.

(56) References Cited

U.S. PATENT DOCUMENTS 2,826,373 A * 3/1958 Schwartz ..... 242/564.1
3,892,368 A * 7/1975 Ricards ..... 242/564
4,003,525 A * 1/1977 Podvin et al. ..... 242/420.6
4,307,638 A * 12/1981 DeLuca et al. ..... 83/37
4,367,666 A * 1/1983 Toth ..... 83/203
4,690,344 A * 9/1987 Yokota ..... 242/564.1
5,452,832 A * 9/1995 Niada ..... 225/11
6,892,620 B2 * 5/2005 Kapiloff ..... 83/649
2001/0049986 A1 * 12/2001 Roberts et al. ..... 83/13
2002/0033405 A1 * 3/2002 Gergek ..... 225/96
2002/0175182 A1 * 11/2002 Matthews ..... 222/52
2003/0116003 A1 * 6/2003 Kapiloff ..... 83/649
2005/0171634 A1 * 8/2005 York et al. ..... 700/231
2006/0076913 A1 * 4/2006 Rodrian ..... 318/272
2006/0173576 A1 * 8/2006 Goerg et al. ..... 700/236
2007/0080255 A1 * 4/2007 Witt et al. ..... 242/563.2

* cited by examiner

*Primary Examiner* — Ghassem Alie
*Assistant Examiner* — Bharat C Patel

(57) ABSTRACT

A power-operated toilet paper dispensing device for automatically providing a desired quantity of existing toilet paper as needed by a user may include a housing adapted to be affixed to a support surface. Further, the device may include a plurality of spindles situated within the housing. Each of the spindles may receive and support a corresponding roll of toilet paper. A mechanism may be included for automatically and independently rotating each of the spindles along a corresponding first rotational path defined within the housing. Such a mechanism may be automatically responsive to a triggering event such that a first one of the spindles automatically and independently articulate along the corresponding first rotational path while a second one of the spindles remains statically disposed at a fixed position within the housing. Additionally, the automatically and independently rotating mechanism may automatically detect the triggering event at a location exterior of the housing.

15 Claims, 6 Drawing Sheets

POWER-OPERATED TOILET PAPER DISPENSING DEVICE AND ASSOCIATED METHOD

CROSS REFERENCE TO RELATED APPLICATIONS

This application claims the benefit of U.S. Provisional Application No. 61/065,832, filed Feb. 19, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tissue dispensers and, more particularly, to a power-operated toilet paper dispensing device for holding and automatically dispensing toilet tissue.

2. Prior Art

Proper hygiene is a key factor in maintaining a healthy and happy existence. Reducing germs and bacteria, hygiene rituals are important for making a person feel clean and fresh on a daily basis. Brushing one's teeth, taking a quick shower or enjoying a long, hot soak in the bathtub are all activities that can cleanse the body and refresh the spirit. Although soaps and deodorants provide an efficient means of cleansing the body and bating odors, trying to maintain that level of cleanliness throughout the day can be very challenging. In particular, maintaining a level of freshness after using the restroom is of utmost concern for most people. Perhaps the most crucial factor in maintaining cleanliness after utilizing the facilities is simple toilet tissue. Unfortunately for many consumers, especially those who suffer limited mobility, removing toilet tissue from a dispenser can be difficult. This is often the case when utilizing public restroom facilities, as the oversized rolls of toilet paper stored in industrial use tissue dispensers can be heavy and awkward to retrieve. Let's face it. Who hasn't attempted to remove toilet tissue from a dispenser, only to tear off minute, unusable pieces of tissue? Another problem associated with many models of toilet tissue dispensers, has to do with the open design of the dispenser. Although unpleasant to discuss, this open design allows the tissue to be exposed to the slew of germs and bacteria common to even the cleanest of bathrooms. Further, as these dispensers are typically positioned directly next to the toilet and sink, they can be easily splashed or sprayed by water, as well as by beauty products such as hair spray and perfume, rendering the toilet tissue unclean and unusable. As many would attest, reaching for toilet tissue only to find that the tissue is wet and soggy can be a very unsettling experience.

Accordingly, a need remains for a power-operated toilet paper dispensing device in order to overcome the above-noted shortcomings. The present invention satisfies such a need by providing a device that is convenient and easy to use, durable in design, and designed for holding and automatically dispensing toilet tissue. The motorized tissue dispenser would offer consumers a simple and efficient means of dispensing toilet tissue.

BRIEF SUMMARY OF THE INVENTION

In view of the foregoing background, it is therefore an object of the present invention to provide a device for holding and automatically dispensing toilet tissue. These and other objects, features, and advantages of the invention are provided by a power-operated toilet paper dispensing device.

A power-operated toilet paper dispensing device for automatically providing a desired quantity of existing toilet paper as needed by a user may include a housing adapted to be affixed to a support surface. Such a housing may advantageously be manufactured of lightweight plastic and may be easily secured in public restroom stalls, or may be manufactured of metal, wood, or any other suitable material and designed to blend seamlessly into a user's home bathroom theme, as is understood by one skilled in the art. Further, the device may include a plurality of spindles situated within the housing. Each of the spindles may be adapted to receive and support a corresponding roll of the existing toilet paper. Of course, one skilled in the art understands that depending on the application, the spindles may be manufactured to fit standard toilet paper rolls purchased for home use, or may be heavier duty to support larger commercial toilet paper rolls.

In addition, a mechanism may be included for automatically and independently rotating each of the spindles along a corresponding first rotational path defined within the housing. Such an automatic and independently rotating mechanism may be automatically responsive to a triggering event such that a first one of the spindles may be automatically and independently articulated along the corresponding first rotational path while a second one of the spindles remains statically disposed at a fixed position within the housing. Additionally, the automatically and independently rotating mechanism may automatically detect the triggering event at a location exterior of the housing. Such a triggering event may be a user manually operating a user interface, waving a hand over a motion sensor, or even speaking a command.

The automatically and independently rotating mechanism may further include a sensor positioned on an outer surface of the housing. Such a sensor may be activated by motion, sound or voice, vibrations, or may be any other mechanical sensor as would be obvious to one skilled in the art. Further, the mechanism may include a plurality of motors seated within the housing and communicatively coupled to the sensor respectively. Each of the motors may have a corresponding drive shaft egressing outwardly therefrom and extending along a linear path registered parallel to longitudinal lengths of the spindles respectively. In operation, the sensor may generate a first control signal upon detecting a first triggering event. The first control signal may be transmitted to a first one of the motors and may thereby cause the corresponding drive shaft to rotate along a second rotational path respectively. The motors may be preset by the user to complete a desired number of rotations upon receipt of the first control signal to dispense a corresponding length of toilet paper. For instance, in a public restroom, the proprietor may set the device to rotate the spindles to release only two or three squares of toilet paper per triggering event. This may advantageously reduce the costs and protect the environment by encouraging users to conserve toilet paper rather than using excessive amounts at a time. Such a feature provides an unexpected and unpredictable benefit not rendered obvious by one skilled in the art.

The automatically and independently rotating mechanism may additionally include a plurality of drive gears statically affixed to a corresponding one of the drive shafts. The drive gears may be configured in such a manner that each of the drive gears may rotate along the second rotational path. The second rotational path may be mutually exclusive of the first rotational path. In addition, the mechanism may include a plurality of spring members coupled to axially opposed ends of each of the spindles respectively. Such spring members may be axially compressible along a fulcrum axis of the first rotational path respectively. Also, the mechanism may include a plurality of driven gears anchored to medially situated ones of the spring members. Such driven gears may be rotatably engaged directly to the drive gears respectively and may be thereby caused to rotate along the first rotational paths during operating conditions. Selective rotation of each the driven gears may cause a corresponding one of the spindles to selectively rotate along the first rotational path.

The power-operated toilet paper dispensing device further may include a dispensing tray assembly connected to the housing and situated subjacent to the spindles respectively. Such a dispensing tray assembly may be adapted to temporarily expose a leading portion of the toilet paper prior to being removed from the housing. In addition, the device may include a mechanism for automatically separating the leading portion of the toilet paper from a retained portion of the toilet paper after the sensor detects the triggering event. The device may therefore provide the unexpected and unpredictable benefit of automatically opening the housing, dispensing the toilet paper stored therein, and cutting a predetermined quantity to be employed by the user at their own convenience.

The dispensing tray assembly may additionally include a dispensing tray and an anchor bracket statically connected to an anterior face of the housing. Further, the tray assembly may include a pair of guide rails statically coupled to the dispensing tray and extending upwardly therefrom along a corresponding linear vertical travel path respectively. A first pair of spring members may also be included and concentrically positioned about the guide rails. The first pair of spring members may have axially opposed ends connected to the anchor bracket and the dispensing tray respectively.

The guide rails may have a longitudinal length that is shorter than a longitudinal length of the first pair of spring, members respectively such that the linear vertical travel path may be defined from a top of the guide rails to a top of the first pair of spring members respectively. In addition, the first pair of spring members may be synchronously compressed and expanded along a first vertical linear travel path when at least one of the spindles rotates along the first rotational path. The dispensing tray may advantageously guide the toilet paper out of the housing to be accessed by the user in the most convenient location. Additionally, the tray may ensure the toilet paper does not reach the ground and become contaminated and thereby unusable.

The dispensing tray assembly further may include a motor communicatively coupled to the sensor and responsive to the triggering event. Additionally, the assembly tray may include a cam operably coupled to the motor. Such a cam may be caused to linearly reciprocate along a second vertical linear travel path that is mutually exclusive of the first and second rotational paths respectively. The cam also may be in continuous engagement with the dispensing tray. Further, the motor may be responsive to the sensor such that the dispensing tray may be displaced to a lowered position when at least one of the spindles rotates along the first rotational path. In this manner, before the triggering event occurs, the housing may keep the rolls of toilet paper secure and clean within the housing, free from contaminating environmental conditions. When the user activates the sensor, the mechanism may operate to unroll the toilet paper while lowering the dispensing tray to be accessed by the user.

The housing of the power-operated toilet paper dispensing device may further include a cover plate removably attached to the anterior face of the housing. Such a cover plate may have an open bottom face for permitting the dispensing tray to freely ingress and egress the cover plate. Additionally, the spindles may be coaxially aligned inside the housing. The cover plate may advantageously protect the sanitary toilet tissue within the housing, and may be conveniently removed for replacement of toilet paper rolls when fully depleted.

The automatic separating mechanism may further include a cutting blade and a slot formed within the anchor bracket. In addition, a motor may be communicatively coupled to the sensor and responsive thereto. A cam may be attached to the motor and linearly reciprocated along a first linear horizontal travel path registered posterior of the cutting blade. Also, a second pair of spring members may be attached to the cutting blade and the anchor bracket respectively. Further, the second pair of spring members may be linearly reciprocated along a second linear horizontal travel path when the cam reciprocates along the first linear horizontal travel path. In this manner, the cutting blade may return to a resting position after being forwardly urged to the slot. The automatic separating mechanism may advantageously provide the user with a predetermined quantity of toilet paper with each operation of the device. This provides the benefit of conserving costs and protecting the environment by preventing excessive use of toilet paper.

The present invention may further include a method for automatically dispensing a desired quantity of existing toilet paper as needed by a user. Such a method may include the chronological steps of first providing and affixing a housing to a support surface. Next the method may include providing a plurality of spindles. Third, the method may entail providing and positioning a corresponding roll of the existing toilet paper about each of the spindles.

Fourthly, the method may include positioning the spindles and the toilet paper rolls within the housing. Finally, upon detecting a triggering event, the method may include automatically and independently rotating each of the spindles along a corresponding first rotational path defined within the housing such that a first one of the spindles is automatically and independently articulated along the corresponding first rotational path while a second one of the spindles remains statically disposed at a fixed position within the housing. The triggering event may be automatically detected at a location exterior of the housing.

Eliminating the need to struggle with a bulky and heavy oversized roll of tissue, the device may make retrieving tissue convenient and easy. Ensuring a full size sheet of tissue could be easily removed from the unit, the present invention may spare the user the hassle and frustration associated with attempting to tear a sheet of paper off a roll, only to have the sheet tear into tiny shreds in the process. This may provide the unexpected and unpredictable benefit of keeping restrooms sanitary and free of waste for all users. The device may further prove particularly beneficial to consumers who suffer limited mobility, as well as senior citizens and small children.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
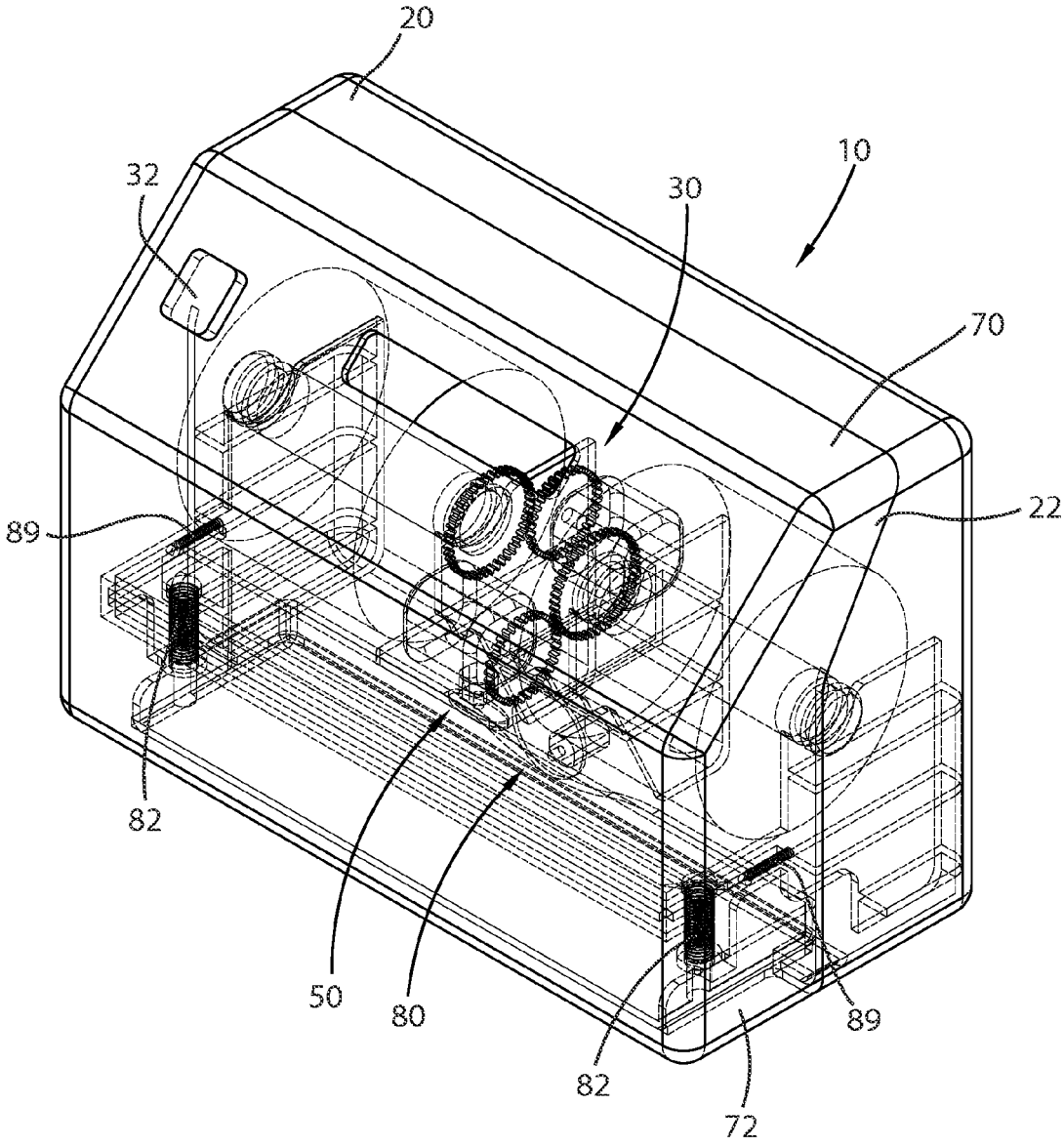
FIG. 1 is a perspective view showing the interrelationship between the major mechanical and electromechanical components of the present invention, in accordance with the present invention.
Figure 2:
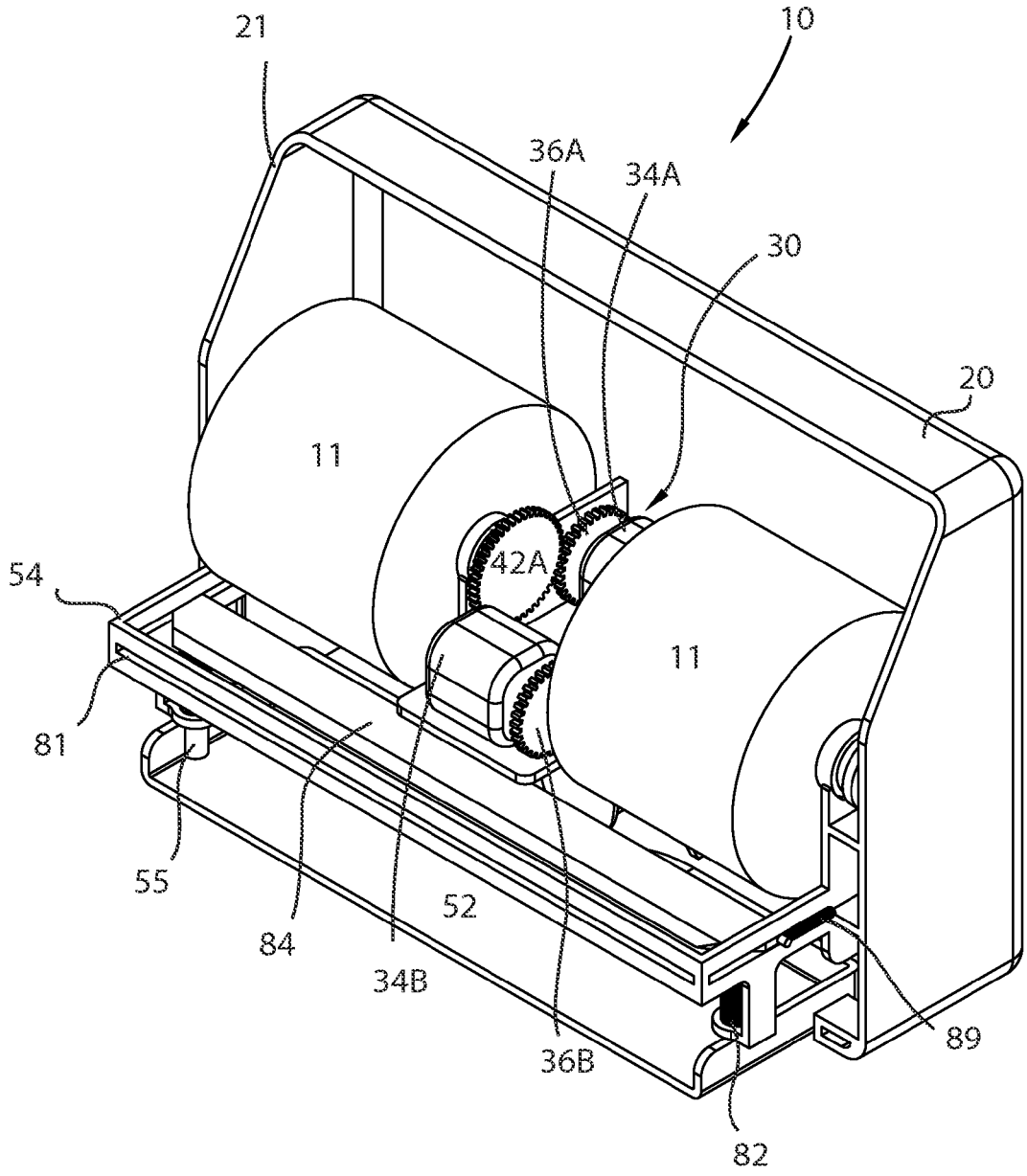
FIG. 2 is a perspective view of the device shown in FIG. 1, with the cover plate removed from the housing.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a motorized tissue dispenser. It should be understood that the motorized tissue dispenser 10 may be used to hold and automatically dispense toilet tissue in many different applications, including public restrooms in restaurants, airports, office bathrooms, city parks, sporting arenas and personal residences.

Referring to FIGS. 1-6 in general, a power-operated toilet paper dispensing device 10 for automatically providing a desired quantity of existing toilet paper 11 as needed by a user may include a housing 20 adapted to be affixed to a support surface. Such a housing 20 may advantageously be manufactured of lightweight plastic and may be easily secured in public restroom stalls, or may be manufactured of metal, wood, or any other suitable material and designed to blend seamlessly into a private or public bathroom theme, as understood by one skilled in the art. An internal or external power source 90 may be provided to supply power to the present invention. Also, a manual toggle switch 91 may be provided to permit an authorized user to override an operating mode of the present invention by interrupting power thereto.

Further, the device 10 may include a plurality of spindles 25A, 25B situated within the housing 20. Each of the spindles 25A, 25B may be adapted to receive and support a corresponding roll of the existing toilet paper 11. Of course, one skilled in the art understands that depending on the application, the spindles 25A, 25B may be manufactured to fit standard toilet paper rolls purchased for home use, or may be heavier duty to support larger commercial toilet paper rolls.

In addition, a mechanism 30 may be included for automatically and independently rotating each of the spindles 25A, 25B along a corresponding first rotational path defined within the housing 20. Such an automatic and independently rotating mechanism 30 may be automatically responsive to a triggering event such that a first one of the spindles 25A, 25B may be automatically and independently articulated along the corresponding first rotational path while a second one of the spindles 25A, 25B remains statically disposed at a fixed position within the housing 20. Additionally, the automatically and independently rotating mechanism 30 may automatically detect the triggering event at a location exterior of the housing 20. Such a triggering event may be generated by a user by waving a hand over sensor 32, or speaking an authorized voice command. In particular, sensor 32 may be adapted to learn different triggering events such as hold a user's hand in front of the sensor 32 for a predetermined period of time or quickly waving the user's hand in front of the sensor 32. Each triggering event may cause the sensor 32 to generate a unique signal for rotating a desired one of the spindles 25A, 25B. For example, sensor 32 may generate a first control signal upon detecting a first triggering event or generate a second control signal upon detecting a second triggering event.

Still referring to FIGS. 1-5, the automatically and independently rotating mechanism 30 may further include the sensor 32 positioned on an outer surface 22 of the housing 20. Such a sensor 32 may be activated by motion, sound or voice, vibrations, or may be any other mechanical sensor, as would be obvious to one skilled in the art.

Further, mechanism 30 may include a plurality of motors 34A, 34B seated within the housing 20 and communicatively coupled to sensor 32 respectively. Each of the motors 34A, 34B may have a corresponding drive shaft 36A, 36B egressing outwardly therefrom and extending along a linear path registered parallel to longitudinal lengths of the spindles 25A, 25B respectively.

For example, the first control signal may be transmitted to a first one of the motors 34A and may thereby cause the corresponding drive shaft 36A to rotate along a second rotational path respectively. Likewise, the second control signal may be transmitted to a second one of the motors 34B and may thereby cause the corresponding drive shaft 36B to rotate along a second rotational path respectively.

The motors 34A, 34B may be preset by the user to complete a desired number of rotations upon receipt of the first and second control signals to dispense a corresponding length of toilet paper 11. For instance, in a public restroom, the proprietor may set the device 10 to rotate spindles 25A, 25B to release only two or three squares of toilet paper, per detected triggering event. This may advantageously reduce the costs and protect the environment by encouraging users to conserve toilet paper rather than using excessive amounts at a time. Such a feature provides an unexpected and unpredictable benefit not rendered obvious by one skilled in the art.

Again referring to FIGS. 1-5, as a whole, the automatically and independently rotating mechanism 30 may additionally include a plurality of drive gears 38A, 38B statically affixed to a corresponding one of the drive shafts 36A, 36B. The drive gears 38A, 38B may be configured in such a manner that each of the drive gears 38A, 38B rotate along the second rotational path. The second rotational path may be mutually exclusive of the first rotational path.

In addition, mechanism 30 may include a plurality of spring members 40A, 40B coupled to axially opposed ends of each of the spindles 25A, 25B respectively. Such spring members 40A, 40B may be axially compressible along a fulcrum axis of the first rotational path respectively, when replacing an empty toilet paper roll with a new toilet paper roll 11. Also, mechanism 30 may include a plurality of driven gears 42A, 42B anchored to medially situated ones of the spring members 40A, 40B. Such driven gears 42A, 42B may be rotatably engaged directly to the drive gears 38A, 38B respectively and thereby may be caused to rotate along the first rotational paths during operating conditions. Selective rotation of each driven gear 42A, 42B may cause a corresponding one of the spindles 25A, 25B to selectively rotate along the first rotational path.

Now referring to FIGS. 2, 3*b*, 4 and 5, the power-operated toilet paper dispensing device 10 further may include a dispensing tray assembly 50 connected to housing 20 and situated subjacent to the spindles 25A, 25B respectively. Such a dispensing tray assembly 50 may be adapted to temporarily expose a leading portion of the toilet paper 11 prior to being removed from the housing 20.

In addition, the device 10 may include a mechanism 80 for automatically separating the leading portion of the toilet paper 11 from a retained portion of the toilet paper 11 after sensor 32 detects the triggering event. The device 10 may therefore provide the unexpected and unpredictable benefit of automatically opening the housing 20, dispensing the toilet paper 11 stored therein, and cutting off a predetermined quantity of the toilet paper 11 to be used by the user at their own convenience.

The dispensing tray assembly 50 may additionally include a dispensing tray 52 and an anchor bracket 54 statically connected to an anterior face 21 of the housing 20. Further, the tray assembly 50 may include a pair of guide rails 55 statically coupled to the dispensing tray 52 and extending upwardly therefrom along a corresponding linear vertical travel path respectively. A first pair of spring members 82 may also be included and concentrically positioned about the guide rails 55.

The first pair of spring members 82 may have axially opposed ends connected to the anchor bracket 54 and the dispensing tray 52 respectively. The guide rails 55 may have a longitudinal length that is shorter than a longitudinal length of the first pair of spring members 82 respectively such that the linear vertical travel path may be defined from a top of the guide rails 55 to a top of the first pair of spring members 82 respectively.

In addition, the first pair of spring members 82 may be synchronously compressed and expanded along a first vertical linear travel path when at least one of the spindles 25A, 25B rotates along the first rotational path. The dispensing tray 52 may advantageously guide the toilet paper 11 out of the housing 20 to be accessed by the user in the most convenient location. Additionally, the tray 52 may ensure the toilet paper 11 does not reach the ground and become contaminated and thereby unusable.

The dispensing tray assembly 50 further may include a motor 60 communicatively coupled to the sensor 32 and responsive to the triggering event. Additionally, the tray assembly 50 may include a cam 62 operably coupled to the motor 60. Such a cam 62 may be caused to linearly reciprocate along a second vertical linear travel path that is mutually exclusive of the first and second rotational paths respectively. The cam 62 also may be in continuous engagement with the dispensing tray 52.

Further, motor 60 may be responsive to the sensor 32 such that the dispensing tray 52 may be displaced to a lowered position when at least one of the spindles 25A, 25B rotates along the first rotational path. In this manner, before the triggering event occurs, the housing 20 may keep the rolls of toilet paper 11 secure and clean within the housing 20, free from contaminating environmental conditions. When the user activates the sensor 32, mechanism 30 may operate to unroll the toilet paper 11 while lowering the dispensing tray 52 to be accessed by the user.

Figure 3A:
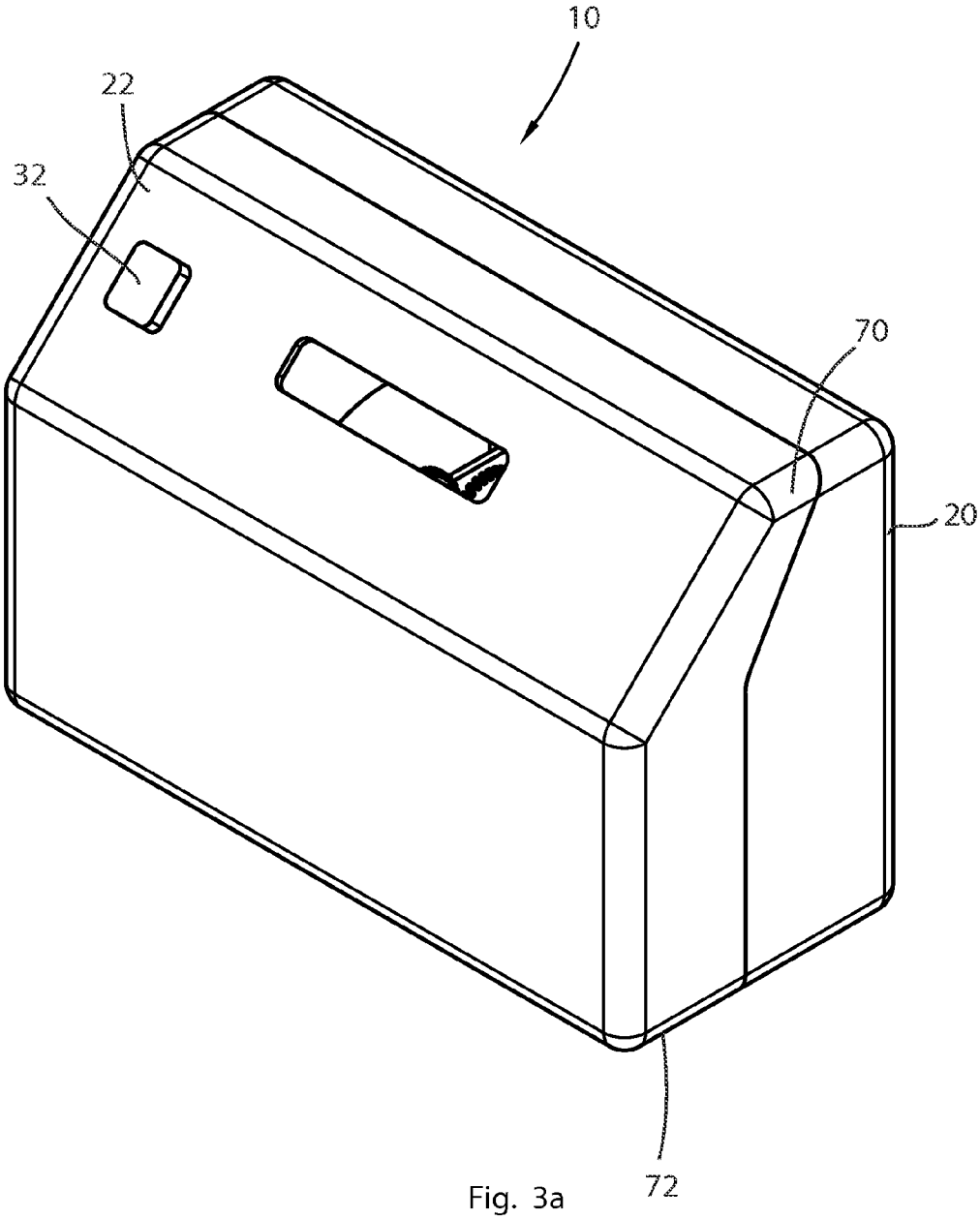
FIG. 3*a* is a perspective view of the device shown in FIG. 1, with an opaque cover plate attached to the housing.
Figure 3B:
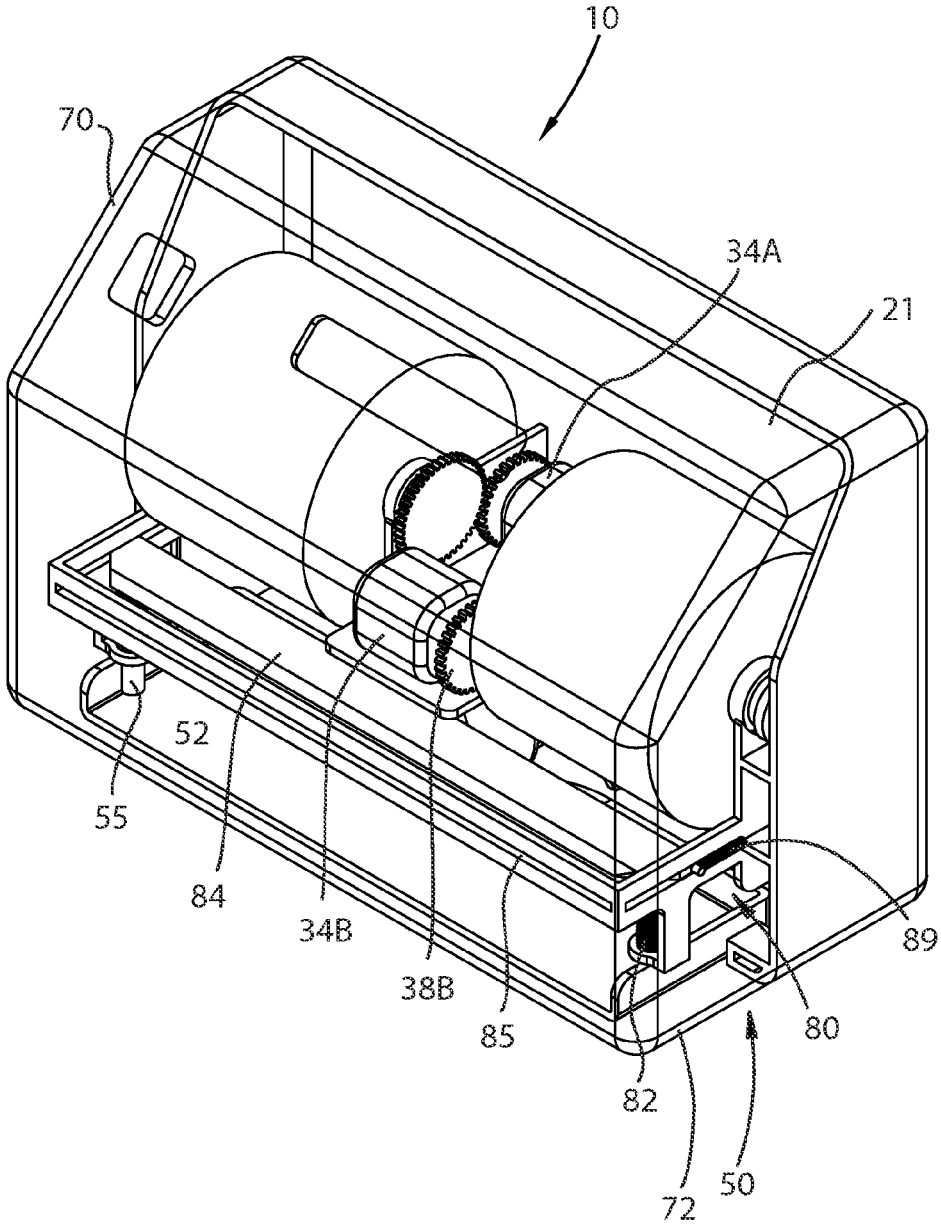
FIG. 3*b* is a perspective view of the device shown in FIG. 1, with a transparent cover plate attached to the housing.
Figure 4:
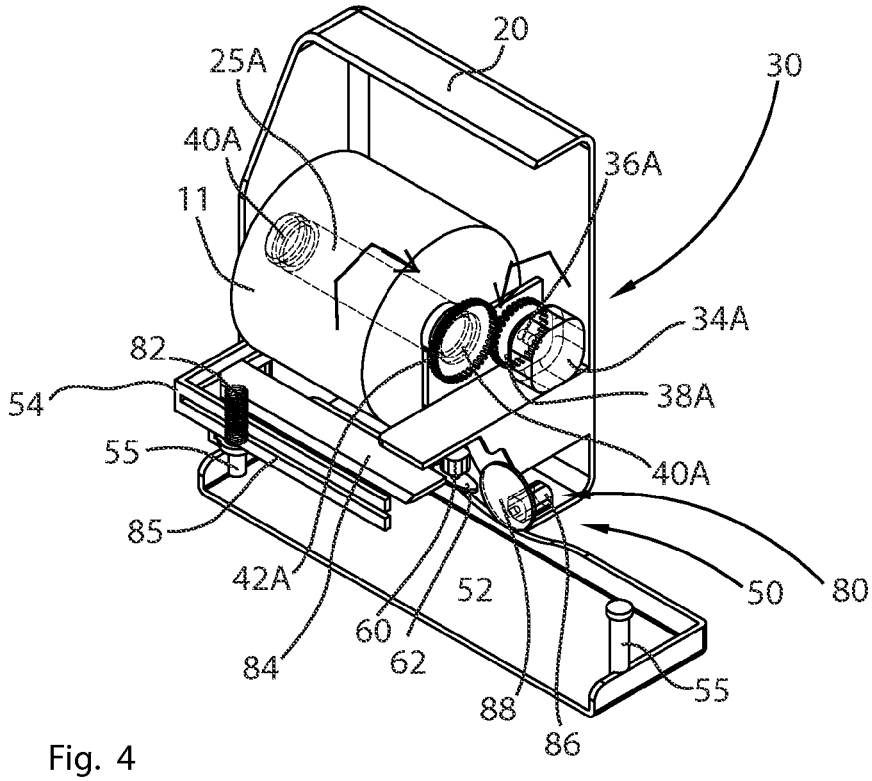
FIG. 4 is a break away view showing a first half of the rotating mechanism.
Figure 5:
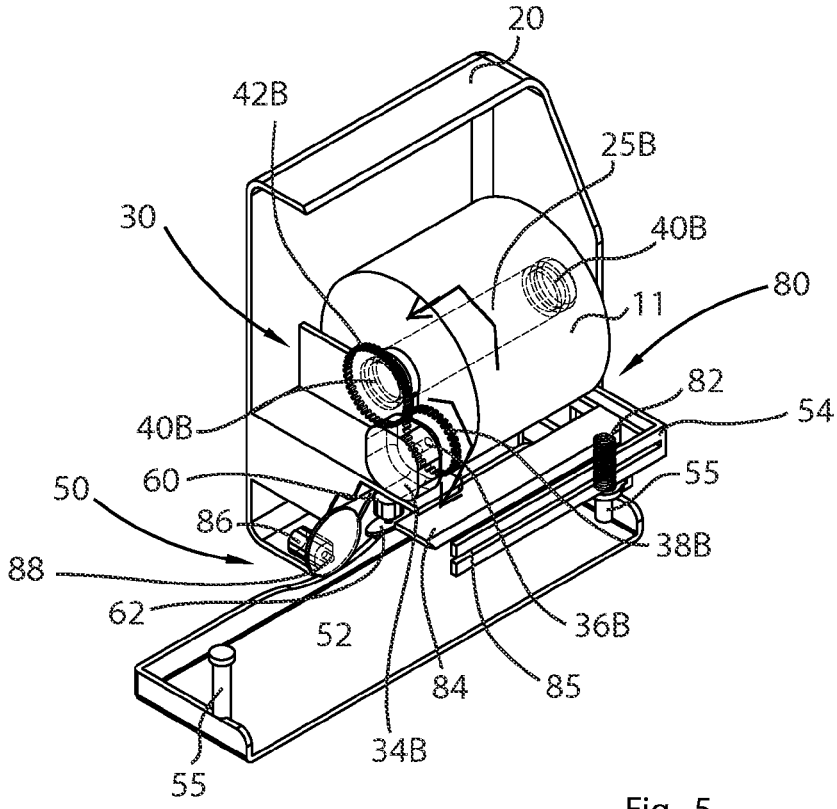
FIG. 5 is a break away view showing a second half of the rotating mechanism.
Figure 6:
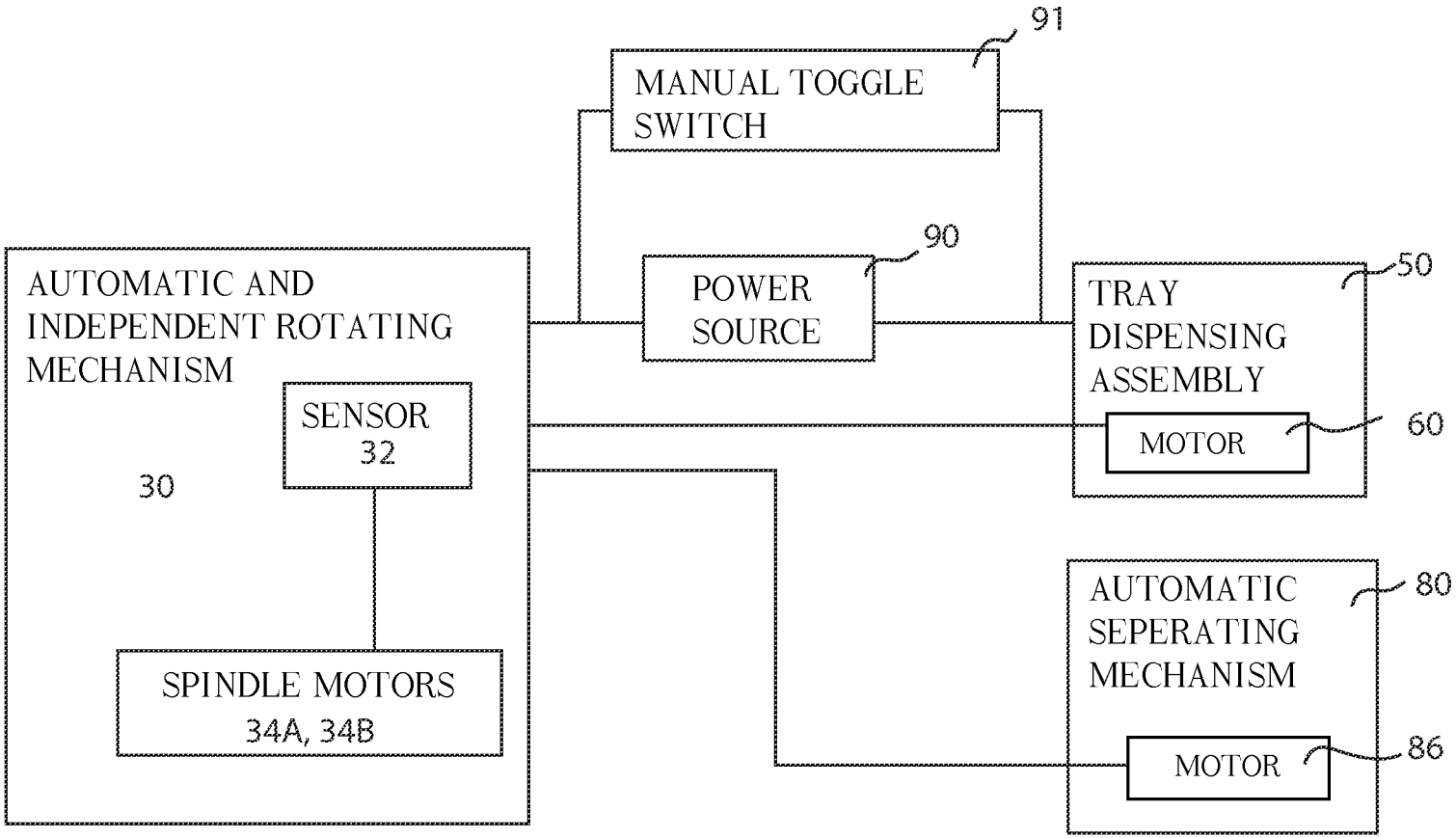
FIG. 6 is a high-level schematic block diagram showing the interrelationship between the major electronic components of the present invention.

Referring now to FIGS. 3*a*, 3*b* and 4, the housing 20 of the power-operated toilet paper dispensing device 10 may further include a cover plate 70 removably attached to the anterior face 21 of the housing 20. Such a cover plate 70 may have an open bottom face 72 for permitting the dispensing tray 52 to freely ingress and egress the cover plate 70. Additionally, the spindles 25A, 25B may be coaxially aligned inside the housing 20. The cover plate 70 may advantageously protect the sanitary toilet tissue within the housing 20, and may be conveniently removed for replacement of toilet paper rolls when fully depleted.

An automatic separating mechanism 80 may include a cutting blade 84 and a slot 85 formed within the anchor bracket 54. In addition, a motor 86 may be communicatively coupled to sensor 32 and responsive thereto. A cam 88 may be attached to the motor 86 and linearly reciprocated along a first linear horizontal travel path registered posterior of the cutting blade.

Also, a second pair of spring members 89 may be attached to the cutting blade 84 and the anchor bracket 54 respectively. Further, the second pair of spring members 89 may be linearly reciprocated along a second linear horizontal travel path when the cam 88 reciprocates along the first linear horizontal travel path. In this manner, the cutting blade 84 may return to a resting position after being forwardly urged to the slot 85. The automatic separating mechanism 80 may advantageously provide the user with a predetermined quantity of toilet paper 11 with each operation of the device 10. This provides the benefit of conserving costs and protecting the environment by preventing excessive use of toilet paper.

The present invention 10 may further include a method for automatically dispensing a desired quantity of existing toilet paper 11 as needed by a user. Such a method may include the chronological steps of first providing and affixing a housing 20 to a support surface. Next, the method may include providing a plurality of spindles 25A, 25B. Third, the method may entail providing and positioning a corresponding roll of the existing toilet paper 11 about each of the spindles 25A, 25B. Fourthly, the method may include positioning the spindles 25A, 25B and the toilet paper rolls within the housing 20.

Upon detecting a triggering event, the method may include automatically and independently rotating each of the spindles 25A, 25B along a corresponding first rotational path defined within the housing 20 such that a first one of the spindles 25A is automatically and independently articulated along the corresponding first rotational path while a second one of the spindles 25B remains statically disposed at a fixed position within the housing 20. The triggering event may be automatically detected at a location exterior of the housing 20.

Eliminating the need to struggle with a bulky and heavy oversized roll of tissue, the device 10 may make retrieving tissue convenient and easy. Ensuring a full size sheet of tissue could be easily removed from the unit, the present invention 10 may spare the user the hassle and frustration associated with attempting to tear a sheet of paper off a roll, only to have the sheet tear into tiny shreds in the process. This may provide the unexpected and unpredictable benefit of keeping restrooms sanitary and free of waste for all users. The device 10 may further prove particularly beneficial to consumers who suffer limited mobility, as well as senior citizens and small children.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A power-operated toilet paper dispensing device for automatically providing a desired quantity of existing toilet paper as needed by a user, said power-operated toilet paper dispensing device comprising:

a housing adapted to be affixed to a support surface;

a plurality of spindles situated within said housing, each of said spindles being adapted to receive and support a corresponding roll of the existing toilet paper; and means for automatically and independently rotating each of said spindles along a corresponding first rotational path defined within said housing;

wherein said automatically and independently rotating means is automatically responsive to a triggering event such that a first one of said spindles is automatically and independently articulated along said corresponding first rotational path while a second one of said spindles remains statically disposed at a fixed position within said housing;

wherein said spindles are co-axially aligned and spaced apart within said housing;

wherein said corresponding first rotational path of said first one of said spindles is co-axially aligned with said corresponding first rotational path of said second one of said spindles.

2. The power-operated toilet paper dispensing device of claim 1, wherein said automatically and independently rotating means comprises:

a sensor positioned on an outer surface of said housing;

a plurality of motors seated within said housing and communicatively coupled to said sensor respectively, each of said motors having a corresponding drive shaft egressing outwardly therefrom and extending along a linear path registered parallel to longitudinal lengths of said spindles respectively;

wherein said sensor generates a first control signal upon detecting a first triggering event, said first control signal being transmitted to a first one of said motors and thereby causing said corresponding drive shaft to rotate along a second rotational path respectively.

3. The power-operated toilet paper dispensing device of claim 2, wherein said automatically and independently rotating means further comprises:

a plurality of drive gears statically affixed to a corresponding one of said drive shafts, said drive gears being configured in such a manner that each of said drive gears rotate along said second rotational path, said second rotational path being mutually exclusive of said first rotational path;

a plurality of spring members coupled to axially opposed ends of each of said spindles respectively, said spring members being axially compressible along a fulcrum axis of said first rotational path respectively; and a plurality of driven gears anchored to medially situated ones of said spring members, said driven gears being rotatably engaged directly to said drive gears respectively and thereby being caused to rotate along said first rotational paths during operating conditions;

wherein selective rotation of each said driven gears causes a corresponding one of said spindles to selectively rotate along said first rotational path.

4. The power-operated toilet paper dispensing device of claim 1, further comprising:

a dispensing tray assembly connected to said housing and situated subjacent to said spindles respectively, said dispensing tray assembly being adapted to temporarily expose a leading portion of the toilet paper prior to being removed from said housing.

5. The power-operated toilet paper dispensing device of claim 4, wherein said housing comprises: a cover plate removably attached to said anterior face of said housing, said cover plate having an open bottom face for permitting said dispensing tray to freely ingress and egress said cover plate.

6. The power-operated toilet paper dispensing device of claim 1, wherein said spindles are coaxially aligned inside said housing.

7. A power-operated toilet paper dispensing device for automatically providing a desired quantity of existing toilet paper as needed by a user, said power-operated toilet paper dispensing device comprising:

a housing adapted to be affixed to a support surface;

a plurality of spindles situated within said housing, each of said spindles being adapted to receive and support a corresponding roll of the existing toilet paper; and means for automatically and independently rotating each of said spindles along a corresponding first rotational path defined within said housing;

wherein said automatically and independently rotating means is automatically responsive to a triggering event such that a first one of said spindles is automatically and independently articulated along said corresponding first rotational path while a second one of said spindles remains statically disposed at a fixed position within said housing;

wherein said automatically and independently rotating means automatically detects said triggering event at a location exterior of said housing;

wherein said spindles are co-axially aligned and spaced apart within said housing;

wherein said corresponding first rotational path of said first one of said spindles is co-axially aligned with said corresponding first rotational path of said second one of said spindles.

8. The power-operated toilet paper dispensing device of claim 7, wherein said automatically and independently rotating means comprises:

a sensor positioned on an outer surface of said housing;

a plurality of motors seated within said housing and communicatively coupled to said sensor respectively, each of said motors having a corresponding drive shaft egressing outwardly therefrom and extending along a linear path registered parallel to longitudinal lengths of said spindles respectively;

wherein said sensor generates a first control signal upon detecting a first triggering event, said first control signal being transmitted to a first one of said motors and thereby causing said corresponding drive shaft to rotate along a second rotational path respectively.

9. The power-operated toilet paper dispensing device of claim 8, wherein said automatically and independently rotating means further comprises:

a plurality of drive gears statically affixed to a corresponding one of said drive shafts, said drive gears being configured in such a manner that each of said drive gears rotate along said second rotational path, said second rotational path being mutually exclusive of said first rotational path;

a plurality of spring members coupled to axially opposed ends of each of said spindles respectively, said spring members being axially compressible along a fulcrum axis of said first rotational path respectively; and a plurality of driven gears anchored to medially situated ones of said spring members, said driven gears being rotatably engaged directly to said drive gears respectively and thereby being caused to rotate along said first rotational paths during operating conditions;

wherein selective rotation of each said driven gears causes a corresponding one of said spindles to selectively rotate along said first rotational path.

10. The power-operated toilet paper dispensing device of claim 7, further comprising:

a dispensing tray assembly connected to said housing and situated subjacent to said spindles respectively, said dispensing tray assembly being adapted to temporarily expose a leading portion of the toilet paper prior to being removed from said housing; and means for automatically separating the leading portion of the toilet paper from a retained portion of the toilet paper after said sensor detects said triggering event.

11. The power-operated toilet paper dispensing device of claim 10, wherein said dispensing tray assembly comprises:

a dispensing tray;

an anchor bracket statically connected to an anterior face of said housing; and a pair of guide rails statically coupled to said dispensing tray and extending upwardly therefrom along a corresponding linear vertical travel path respectively;

a first pair of spring members concentrically positioned about said guide rails, said first pair of spring members having axially opposed end connected to said anchor bracket and said dispensing tray respectively, said guide rails having a longitudinal length that is shorter than a longitudinal length of said first pair of spring members respectively such that the linear vertical travel path is defined from a top of said guide rails to a top of said first pair of spring members respectively;

wherein said first pair of spring members are synchronously compressed and expanded along a first vertical linear travel path when at least one of said spindles rotates along said first rotational path.

12. The power-operated toilet paper dispensing device of claim 11, wherein said dispensing tray assembly further comprises:

a motor communicatively coupled to said sensor and being responsive to said triggering event;

a cam operably coupled to said motor and being caused to linearly reciprocate along a second vertical linear travel path that is mutually exclusive of said first and second rotational paths respectively; and said cam being in continuous engagement with said dispensing tray;

wherein said motor is responsive to said sensor such that said dispensing tray is displaced to a lowered position when at least one of said spindles rotates along said first rotational path.

13. The power-operated toilet paper dispensing device of claim 11, wherein said housing comprises: a cover plate removably attached to said anterior face of said housing, said cover plate having an open bottom face for permitting said dispensing tray to freely ingress and egress said cover plate.

14. The power-operated toilet paper dispensing device of claim 7, wherein said spindles are coaxially aligned inside said housing.

15. A method for automatically dispensing a desired quantity of existing toilet paper as needed by a user, said method comprising the chronological steps of:

providing and affixing a housing to a support surface;

providing a plurality of spindles;

providing and positioning a corresponding roll of the existing toilet paper about each of said spindles;

positioning said spindles and the toilet paper rolls within said housing; and upon detecting a triggering event, automatically and independently rotating each of said spindles along a corresponding first rotational path defined within said housing such that a first one of said spindles is automatically and independently articulated along said corresponding first rotational path while a second one of said spindles remains statically disposed at a fixed position within said housing;

wherein said triggering event is automatically detected at a location exterior of said housing;

wherein said spindles are co-axially aligned and spaced apart within said housing;

wherein said corresponding first rotational path of said first one of said spindles is co-axially aligned with said corresponding first rotational path of said second one of said spindles.

* * * * *